US010018441B1

(12) United States Patent
Kinsella

(10) Patent No.: US 10,018,441 B1
(45) Date of Patent: Jul. 10, 2018

(54) HANDGUN DISPLAY STAND

(71) Applicant: Kevin G. Kinsella, Cooksville, IL (US)

(72) Inventor: Kevin G. Kinsella, Cooksville, IL (US)

( * ) Notice: Subject to any disclaimer, the term of this patent is extended or adjusted under 35 U.S.C. 154(b) by 0 days.

(21) Appl. No.: 14/609,637

(22) Filed: Jan. 30, 2015

Related U.S. Application Data

(63) Continuation-in-part of application No. 13/736,220, filed on Jan. 8, 2013.

(60) Provisional application No. 61/631,947, filed on Jan. 12, 2012.

(51) Int. Cl.
*F41A 23/18* (2006.01)
*A47B 81/00* (2006.01)
*F16M 13/02* (2006.01)

(52) U.S. Cl.
CPC ..... *F41A 23/18* (2013.01); *A47B 81/005* (2013.01); *F16M 13/022* (2013.01)

(58) Field of Classification Search
CPC ..... F41A 23/00; F41A 23/18
USPC ..... 42/94; 89/37.04
See application file for complete search history.

(56) References Cited

U.S. PATENT DOCUMENTS 945,520 A * 1/1910 Greenwood ..... 248/175
2,764,326 A * 9/1956 Stanton ..... 224/255
3,252,583 A * 5/1966 Walther ..... A47B 81/04 211/119
3,345,027 A 10/1967 Taylor
3,353,728 A * 11/1967 Freed ..... 224/243
3,730,355 A * 5/1973 Feldman ..... A47F 5/0876 211/119
4,716,673 A * 1/1988 Williams et al. ..... 42/95
4,917,248 A * 4/1990 Friskney ..... 211/41.8
5,188,328 A * 2/1993 Thompson ..... 248/309.2
5,503,276 A * 4/1996 Pierce ..... F41A 23/18 211/59.1
D633,978 S * 3/2011 Vande Noord ..... D22/108
8,281,511 B1 * 10/2012 Ligard ..... 42/70.11
2009/0078661 A1 * 3/2009 Kinsella ..... 211/64
2012/0261368 A1 * 10/2012 Klein et al. ..... 211/64
2014/0102999 A1 * 4/2014 Werner ..... 211/64

OTHER PUBLICATIONS

ARTS Airsoft Handgun Display Stand (Types 1 and 2) RedWolf Airsoft Specialist Ltd. Hong Kong Retrieved from Internet URL: www.redwolfairsoft.com on Dec. 5, 2012. Date of first appearance on website unknown.

* cited by examiner

*Primary Examiner* — Derrick R Morgan
(74) *Attorney, Agent, or Firm* — Philip L. Bateman

(57) ABSTRACT

A stand displays and stores a handgun on a horizontal surface. The stand is formed from a single piece of plastic coated wire that is bent into five segments. Two of the segments hold the handgun while the other three segments form a stable base. The angle the first segment makes to the second segment is adjustable and determines the angle at which the handgun leans when displayed.

4 Claims, 9 Drawing Sheets

HANDGUN DISPLAY STAND

CROSS-REFERENCE TO RELATED APPLICATIONS

This application is a continuation in part of U.S. application Ser. No. 13/736,220, Jan. 8, 2013, now pending, that claimed the benefit of U.S. Provisional Application Ser. No. 61/631,947, Jan. 12, 2012.

FIELD OF THE INVENTION

This invention relates to handguns. More particularly, this invention relates to a stand for displaying and storing handguns on a horizontal surface.

BACKGROUND OF THE INVENTION

Handguns are commonly displayed and stored laying flat on their sides on horizontal shelves in retail stores and in gun safes. For a given area of shelf space, more handguns can be stored in an upright position than in a flat position. However, handguns are not stable in an upright position and can easily tip over.

A variety of racks have been used to display and store handguns in an upright position on shelves. The racks are designed to hold a number of handguns. As a result, the racks are often partially empty. For example, if a rack is designed to hold six handguns and a retailer wants to display seven handguns, he has no choice but to use two racks, one or both of which will have empty spaces. Another disadvantage of racks is that they place the handgun in one fixed position, typically upright. A retailer may want to display a handgun in a leaning position, midway between upright and flat.

Handgun display stands for a single handgun have also been disclosed. Taylor, U.S. Pat. No. 3,345,027, Oct. 3, 1967, discloses a handgun display stand having a base and a jaw that grips the trigger guard of a handgun. The jaw is tightened and loosened by turning a threaded bolt. The Taylor display stand is bulky, contains many parts, and a time consuming process with a screwdriver is required to place the handgun on the stand and to remove it from the stand.

Handgun holders consisting of a single piece of wire bent into various shapes have also been disclosed. Greenwood, U.S. Pat. No. 945,520, Jan. 4, 2010, discloses a handgun display stand consisting of a single piece of wire bent into a base, a vertical member, and an angled sleeve. The angled sleeve accommodates a handgun barrel or cylinder (if the handgun is a revolver). The handgun is completely elevated off the surface on which the stand rests. As a result, the angle at which the handgun leans is not adjustable and the handgun is relatively unstable. The handgun plus the stand take up substantial vertical space so the stand is not suitable for shelves having limited heights. Vande Noord, U.S. Pat. No. D633,978, Mar. 8, 2011, discloses a handgun display stand consisting of a single piece of wire. A hook portion attaches to the edge of a shelf and two prongs accommodate the barrels of handguns. The handguns hang suspended from under the shelf. Freed, U.S. Pat. No. 3,353,728, Nov. 21, 1967, discloses a handgun holster consisting of a single piece of wire.

Accordingly, there is a demand for an improved stand for displaying and storing handguns on horizontal shelves. More particularly, there is a demand for such a stand that holds a single handgun, is stable, is easily customized to hold the handgun at the desired leaning angle, is easy and inexpensive to manufacture, is light in weight, and onto which a handgun can be easily and quickly placed and removed.

SUMMARY OF THE INVENTION

The general object of this invention is to provide an improved stand for displaying and storing handguns on horizontal shelves. A more particular object is to provide such a stand that holds a single handgun in a stable position, is stable, is easily customized to hold the handgun at the desired leaning angle, is easy and inexpensive to manufacture, is light in weight, and onto which a handgun can be easily and quickly placed and removed. Another general object of this invention is to provide an improved method for displaying a handgun.

I have invented an assembly of a handgun and a stand on a horizontal surface. The assembly comprises a handgun, a stand, and a horizontal surface for supporting the handgun and a stand. The stand comprises: (i) a first segment of plastic coated wire having a length of two to four inches oriented at an angle of about 10 to 70 degrees to the horizontal surface, the angle being adjustable by hand; (ii) a second segment of plastic coated wire connected to the first segment, the second segment having a length of one-half to two inches and being oriented substantially vertically; and (iii) a horizontal base connected to the second segment, the horizontal base resting on the horizontal surface. The handgun comprises a handle and a barrel, the handle having a center plane dividing the handgun into a left half and a right half that are substantially mirror images, the barrel of the handgun having the first segment of the stand inserted into its barrel and the handle of the handgun resting on the horizontal surface, such that the angle of the center plane of the handgun relative to the horizontal surface is determined by the angle made by the first segment of the stand to the horizontal surface. I have also invented a method for displaying a handgun using the stand.

The stand of this invention displays and stores a single handgun. The handgun is stable because the handle rests on the display surface while the barrel is supported by the stand. The stand is easily customized by bending the first segment to hold the handgun at the desired leaning angle. The stand is easy and inexpensive to manufacture, is light in weight, and does not damage either the handgun or the surface upon which it sits. A handgun can be quickly and easily placed onto the stand and removed from the stand.

DETAILED DESCRIPTION OF THE INVENTION

1. The First Embodiment

The apparatus and method of this invention are best understood by reference to the drawings. Referring first to FIGS. 1 to 4, a first embodiment of the handgun display stand 100 of this invention comprises a single piece of wire that is formed into five segments. The term "wire" is used herein to refer to a piece of material having a generally round cross section with a length much greater than its diameter. Two of the segments hold the handgun while the other three segments form a stable base.

The wire is preferably made of a bendable metal, most preferably steel, having a diameter of about 0.1 to 0.3 inches. If the diameter is less than about 0.1 inches, the stand may bend by the weight of the handgun. If the diameter is greater than about 0.3 inches, the stand is difficult to bend by hand. The term "bendable" means that the wire can be bent and will stay in a new position. The diameter of the wire is preferably about 0.15 to 0.2 inches. The wire is preferably coated with a plastic so it does not scratch the inside of the barrel of the handgun or the surface upon which it sits. Suitable plastics include polyvinyl chloride (PVC), polyethylene, polypropylene, polyamide, polycarbonate, acrylonitrile butadiene styrene (ABS), polystyrene, and the like.

While plastic coated bendable metal wire is the preferred material, the handgun display stand can be made of other materials if the ability to bend to a new position is not essential. For example, the handgun display stand can be made of wire of fiberglass, polyvinyl chloride (PVC), polyethylene, polypropylene, polyamide, polycarbonate, acrylonitrile butadiene styrene (ABS), polystyrene, or the like.

Figure 3:
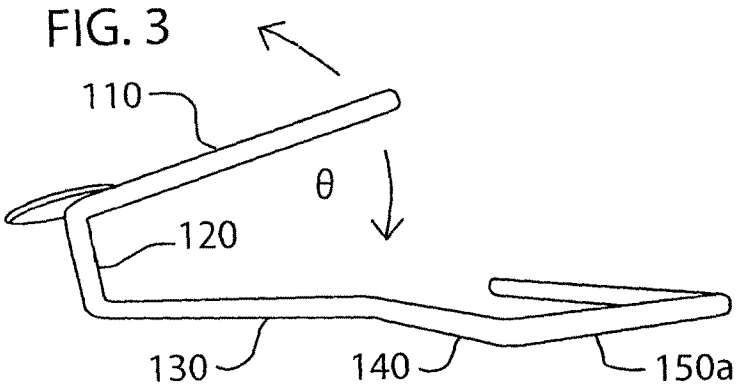
FIG. 3 is side elevation view thereof.
Figure 5:
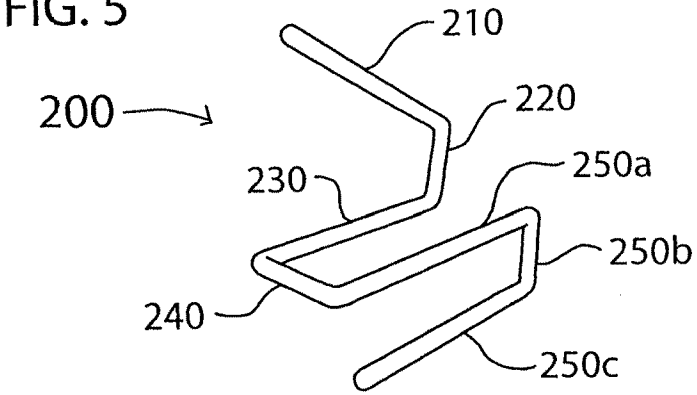
FIG. 5 is a perspective view of a second embodiment of the handgun display stand of this invention.
Figure 8:
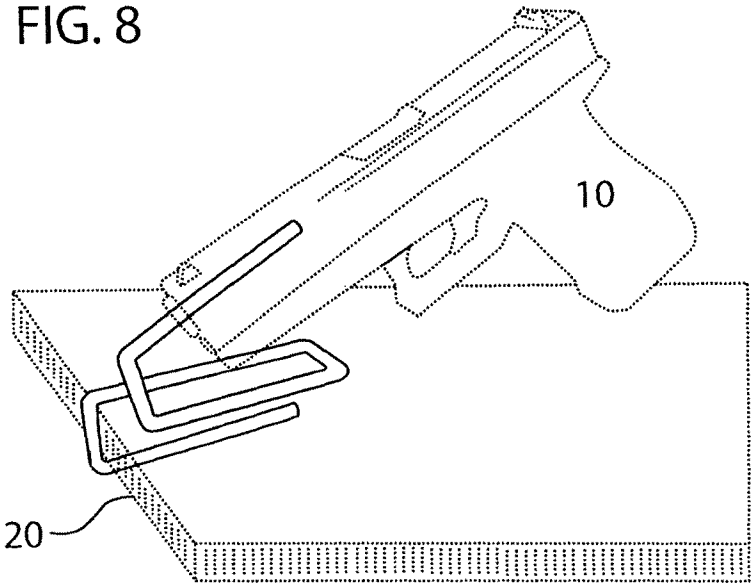
FIG. 8 is a perspective thereof in use holding a handgun.
Figure 6:
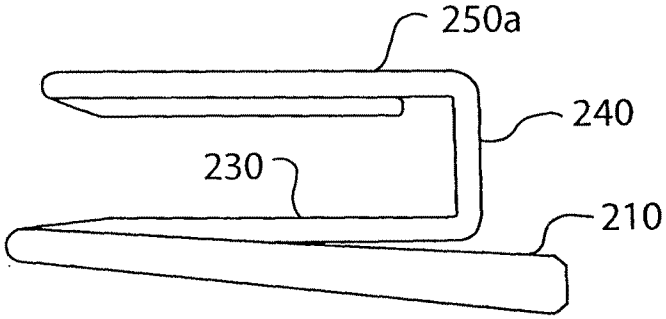
FIG. 6 is a top plan view thereof.
Figure 7:
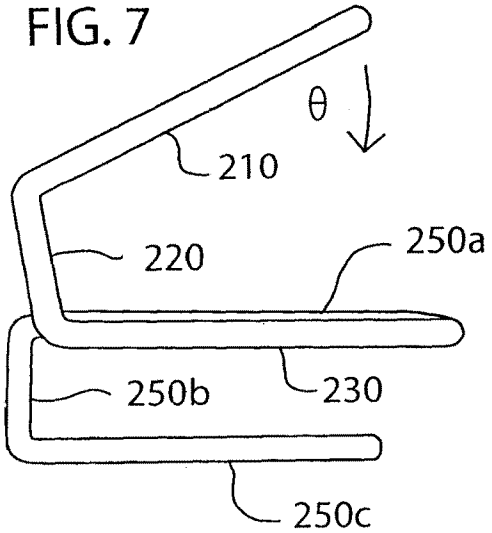
FIG. 7 is side elevation view thereof.
Figure 9:
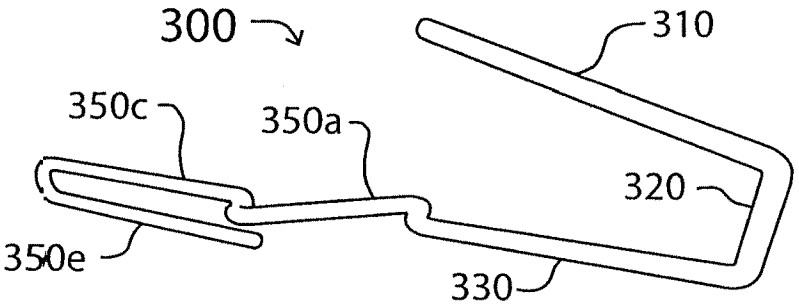
FIG. 9 is a perspective view of a third embodiment of the handgun display stand of this invention.
Figure 12:
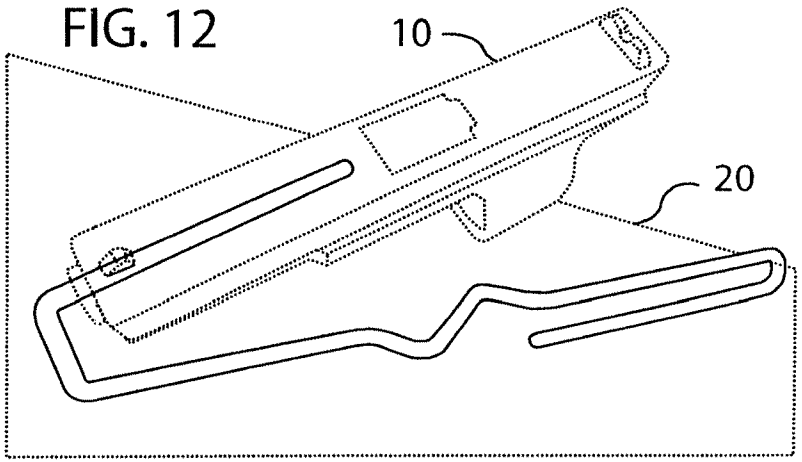
FIG. 12 is a perspective thereof in use holding a handgun.
Figure 10:
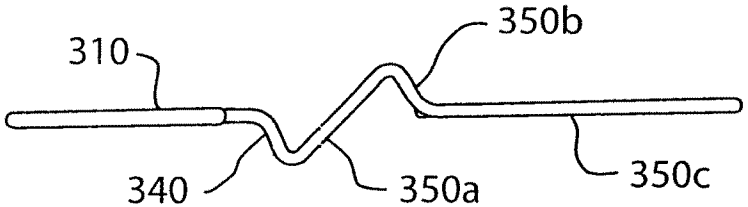
FIG. 10 is a top plan view thereof.
Figure 11:
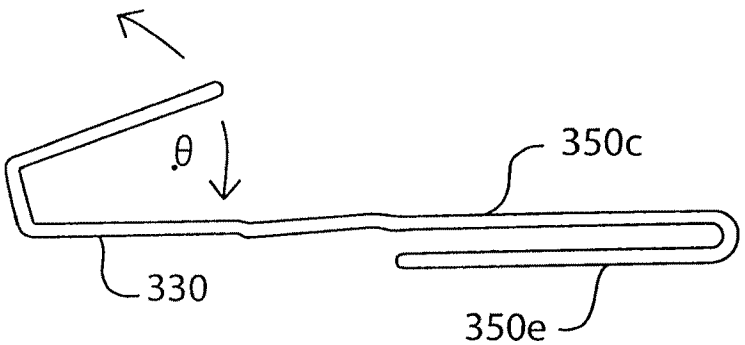
FIG. 11 is side elevation view thereof.
Figure 13:
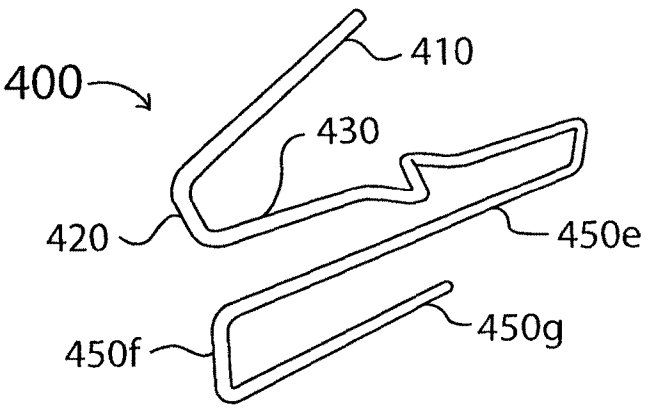
FIG. 13 is a perspective view of a fourth embodiment of the handgun display stand of this invention.
Figure 16:
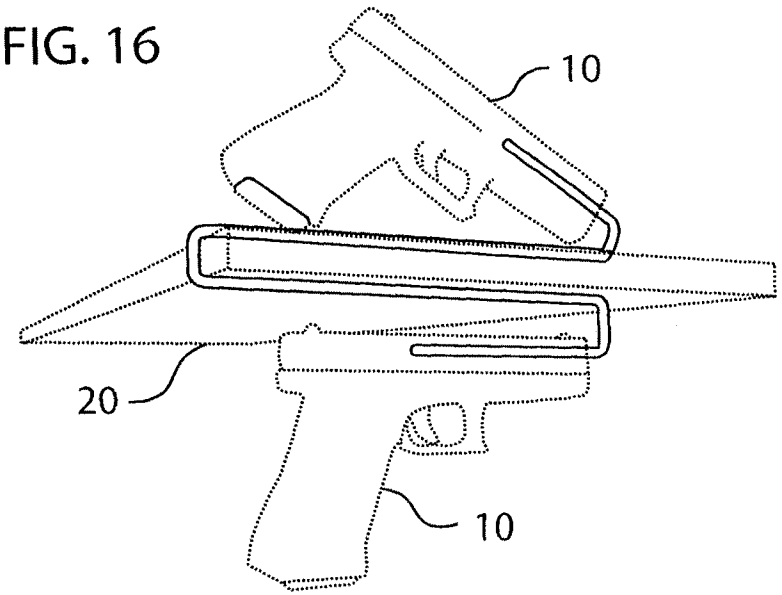
FIG. 16 is a perspective thereof in use holding a handgun.
Figure 14:
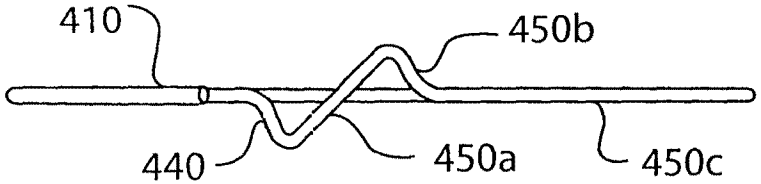
FIG. 14 is a top plan view thereof.
Figure 15:
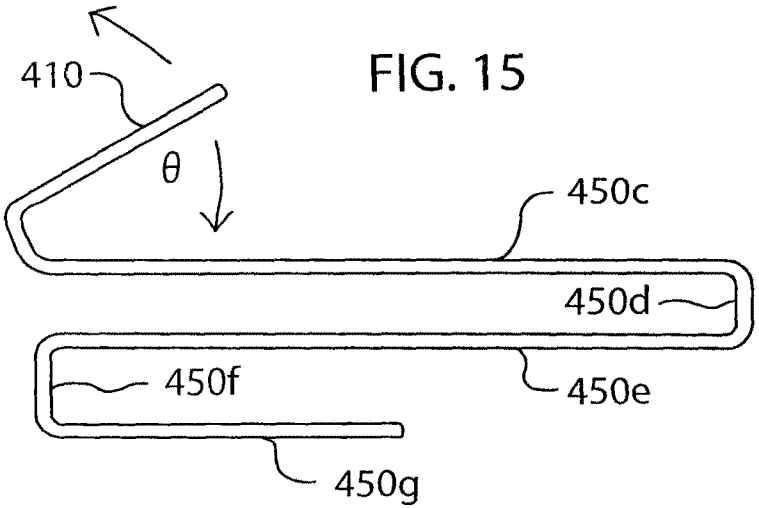
FIG. 15 is side elevation view thereof.
Figure 17:
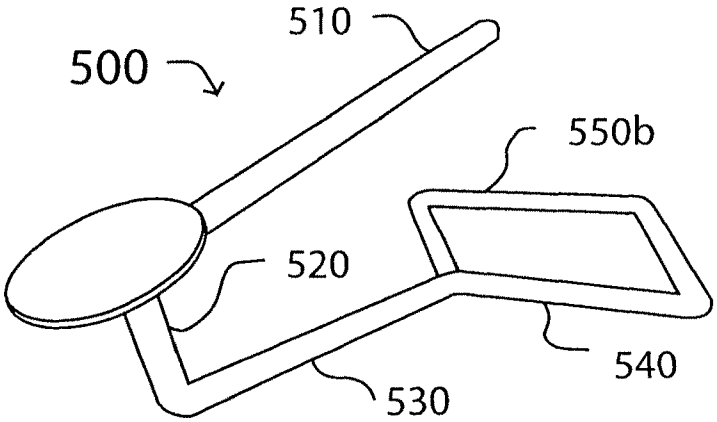
FIG. 17 is a perspective view of a fifth embodiment of the handgun display stand of this invention.
Figure 18:
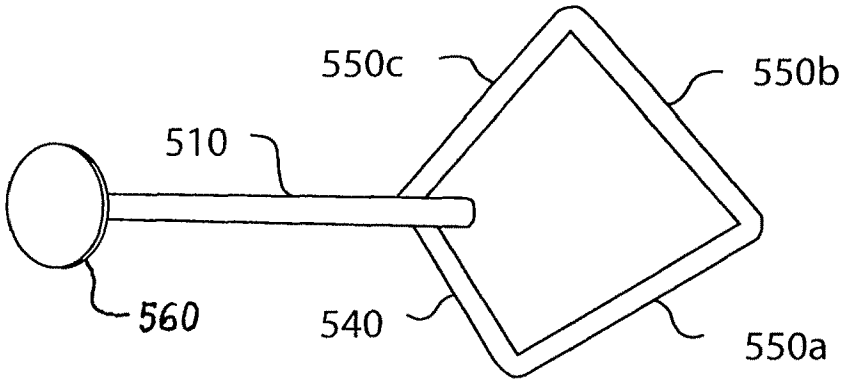
FIG. 18 is a top plan view thereof.
Figure 20:
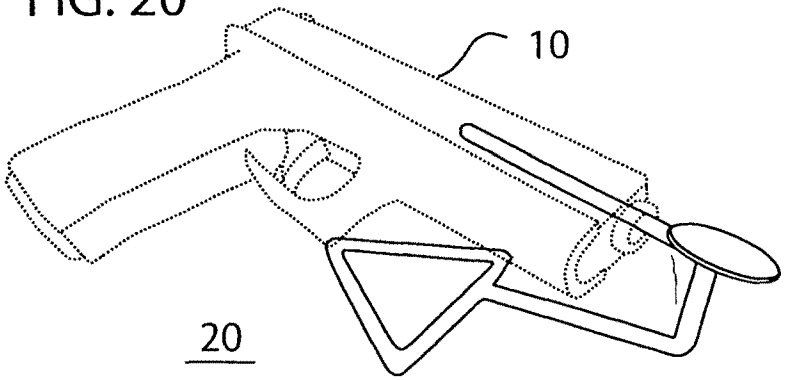
FIG. 20 is a perspective thereof in use holding a handgun.
Figure 19:
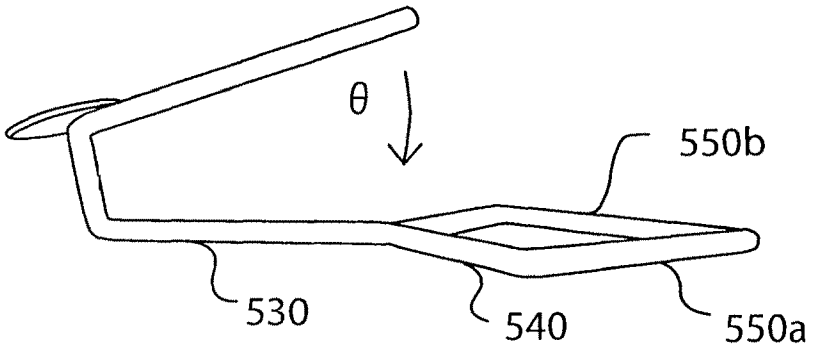
FIG. 19 is side elevation view thereof.
Figure 21:
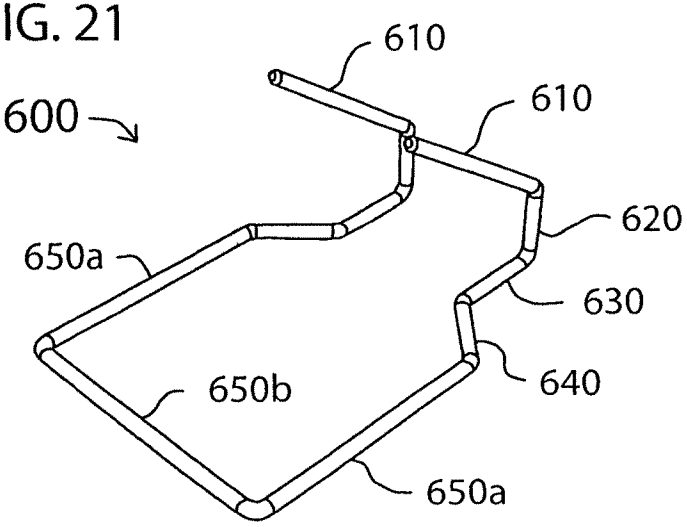
FIG. 21 is a perspective view of a sixth embodiment of the handgun display stand of this invention.
Figure 22:
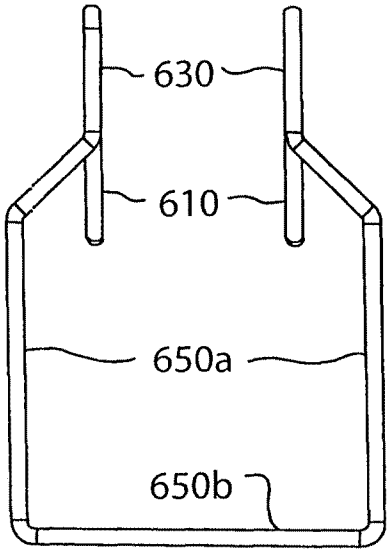
FIG. 22 is a bottom plan view thereof.
Figure 24:
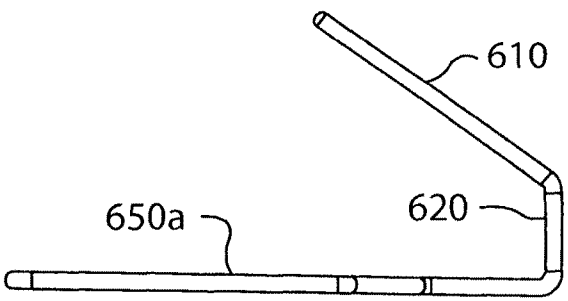
FIG. 24 is a side elevation view thereof.
Figure 23:
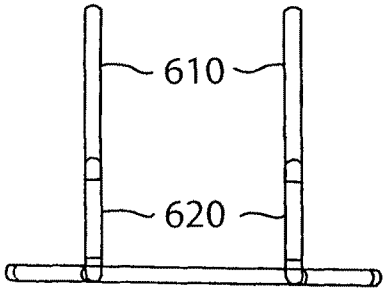
FIG. 23 is an end elevation view thereof.
Figure 25:
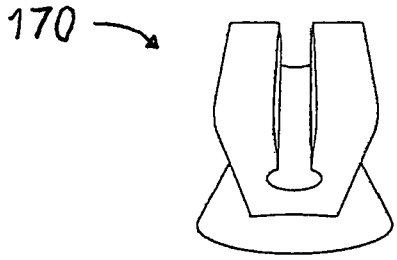
FIG. 25 is a bottom view of a clip.
Figure 26:
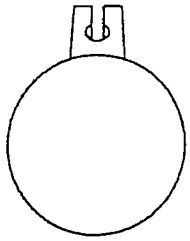
FIG. 26 is a top view thereof.
Figure 27:
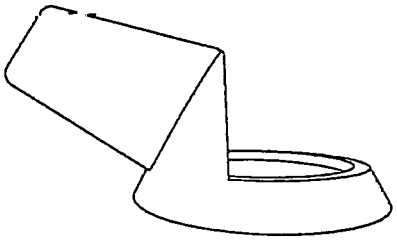
FIG. 27 is a side view thereof.
Figure 28:
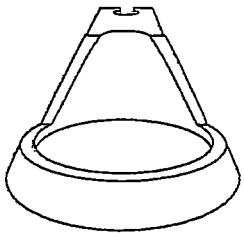
FIG. 28 is a rear view thereof.
Figure 29:
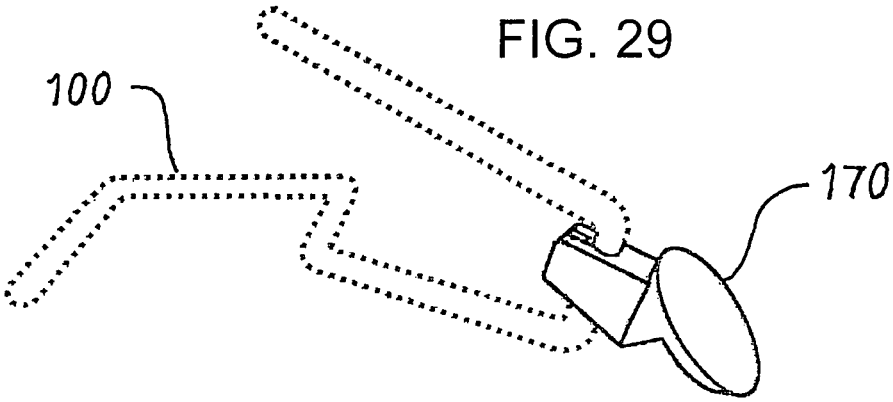
FIG. 29 is a perspective view thereof.

The wire is bent, molded, or otherwise formed into five segments. The first segment 110 contains a terminal proximate (leading) end. The first segment is inserted into the barrel of the handgun being displayed. It is angled upward at an angle θ of about 10 to 70 degrees, preferably about 20 to 50 degrees, as best seen in FIG. 3. As discussed below, this angle is preferably adjustable by the user and determines whether the handgun is displayed upright or leaning. The length of the first segment is generally about one to five inches and preferably about two to four inches. If the length is less than about one inch, the handgun is not held securely. If the length is greater than about five inches, the end of the segment may hit the back of handguns having short barrels. The first segment optionally contains a protective cap on its proximate end to further reduce the possibility of damage to the interior of the barrel of the handgun. The first segment defines a vertical plane with two sides, the importance of which is discussed below.

The second segment 120 is connected to the distal end of the first segment. It is at least partially vertical and is preferably substantially vertical. It is positioned in the same vertical plane as the first segment. The length of the second segment is generally about one-half to two inches and is preferably about one inch. As will be seen, the second segment elevates the end of the barrel of the handgun off the surface so the barrel is not scratched by the surface and so the surface is not scratched by the barrel.

Figure 1:
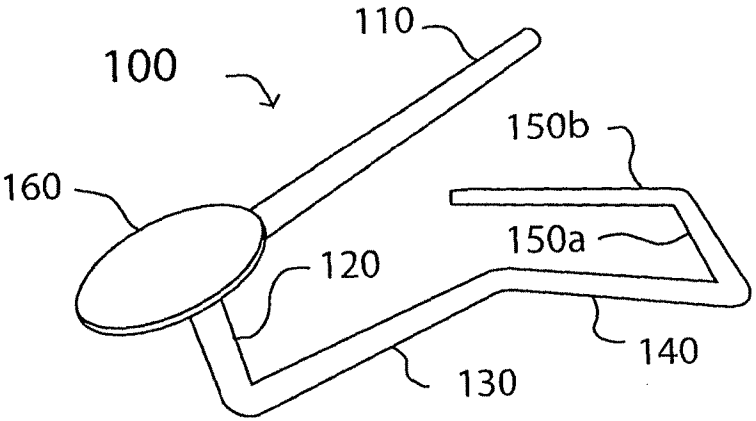
FIG. 1 is a perspective view of a first embodiment of the handgun display stand of this invention.
Figure 2:
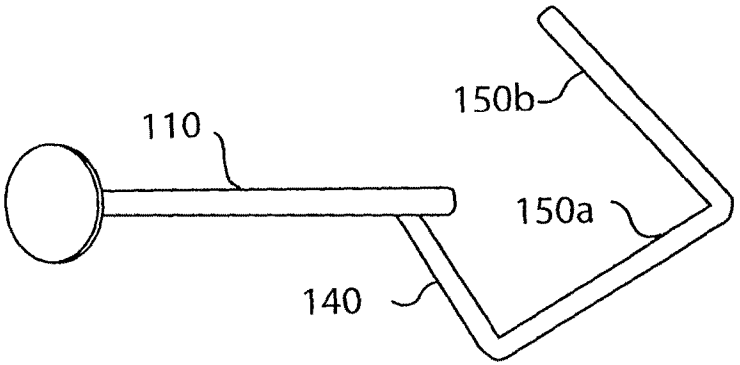
FIG. 2 is a top plan view thereof.

The third segment 130 is connected to the distal end of the second segment. It is horizontal and is positioned in the same vertical plane as the first segment. It is thus located directly below the first segment, as can be seen in FIG. 2. The third segment forms part of the base of the display stand.

The fourth segment 140 is connected to the distal end of the third segment. It is also horizontal and forms part of the base of the display stand. It extends to one of the sides of the vertical plane defined by the first segment.

The fifth segment 150 is connected to the distal end of the fourth segment. It also forms part of the base of the display stand. At least a portion of the fifth segment is horizontal. In the first embodiment, the fifth segment is entirely horizontal and extends from one side of the vertical plane defined by the first segment to the other side. The fifth segment is bent where it intersects the vertical plane defined by the first segment, forming two subsegments 150*a* and 150*b*. The bending of the fifth segment forms a more stable and more compact base than if the fifth segment were straight. If desired for aesthetic or other reasons, the fifth segment can be extended to the distal end of the third segment.

The first embodiment contains an optional circular disc 160 that is attached to the first segment. A label is conveniently affixed to the disc for providing information about the handgun, for example, its manufacturer, its model number, its price, etc. The disc is especially desirable for retailers. The disc shown on the first embodiment is attached permanently to the stand with adhesive. A second optional circular disc 170 is shown in FIGS. 25 to 29. This disc has an integral clip for removable attachment to the display stand. The clip enables the disc to be attached to the stand at any desired position and to be added or removed as desired. The stand is shown in phantom lines for illustration purposes in FIG. 29.

2. Uses and Advantages

Figure 4:
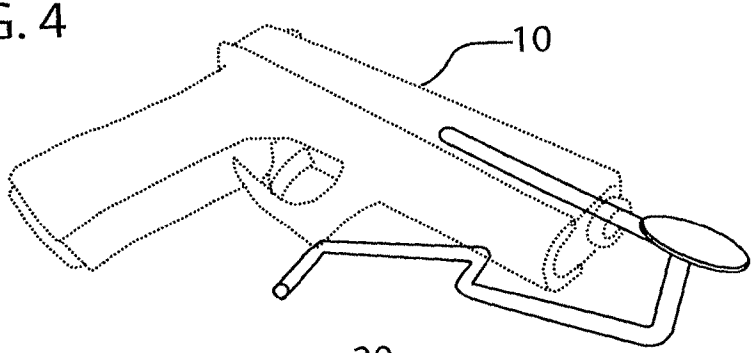
FIG. 4 is a perspective thereof in use holding a handgun.

The uses of the stand can now be considered. Referring now to FIG. 4, a handgun 10 shown displayed and stored on the stand. The stand is shown resting on a horizontal surface 20. It can be seen that the first segment is fully inserted into the barrel and that the lower edge of the handle is resting on the surface. Depending on the angle made by the first segment, the handgun will rest substantially upright or will lean to its side. Stated more precisely, the center plane defined by the handle and barrel of the handgun will be substantially perpendicular to the plane defined the surface upon which it rests or will form an angle to it. This center plane divides the handgun into a left half and a right half that are substantially mirror images.

Figure 32:
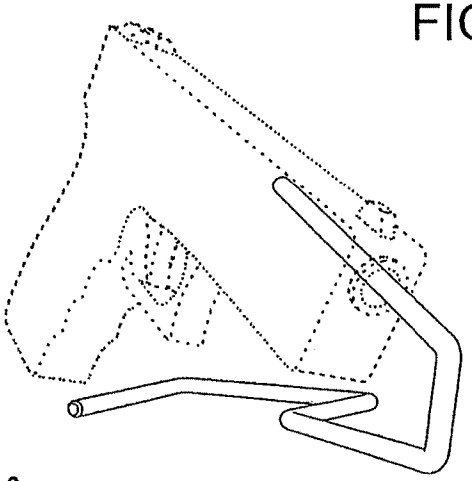
FIG. 32 is a perspective view of the first embodiment being used to display a handgun in a nearly upright position.
Figure 33:
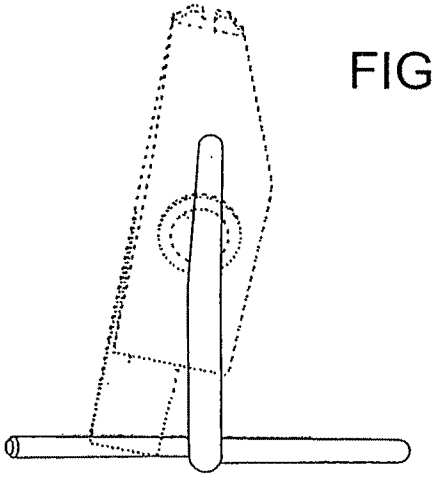
FIG. 33 is an end view thereof.
Figure 30:
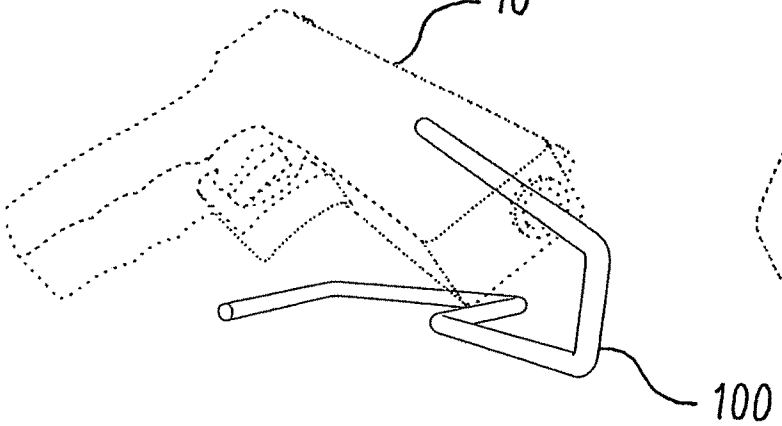
FIG. 30 is a perspective view of the first embodiment being used to display a handgun in a leaning position.
Figure 31:
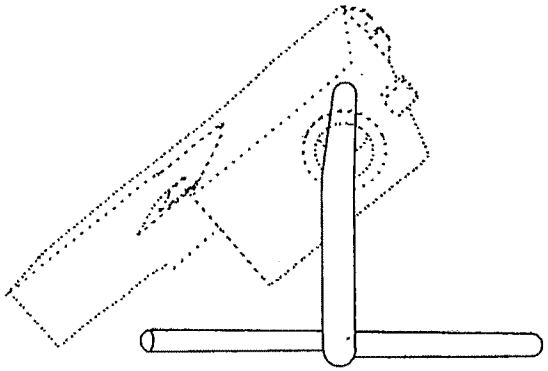
FIG. 31 is an end view thereof.

It can be appreciated that the handgun leans less as the angle made by the first segment is increased. Less leaning is desirable when space is limited and a retailer wants to display as many handguns as possible in a given amount of space. It can also be appreciated that the handgun leans more to one side or the other as the angle made by the first segment is decreased. Greater leaning is desirable for display purposes in a retail store because it provides a better view of certain areas of the handgun. Referring now to FIGS. 30 to 31, the handgun leans substantially when the angle is about 10 degrees relative to the horizontal surface. Referring now to FIGS. 32 to 33, the handgun leans little when the angle is about 45 degrees. The handgun is shown in phantom lines for illustration purposes in FIGS. 30 to 33.

The angle of the first segment is easily adjusted by holding the stand in one hand while pulling or pushing the first segment with the other hand. If the angle were too great, the handle would be elevated off the surface. This is undesirable because it reduces stability.

The first embodiment of the handgun display stand of this invention displays and stores a single handgun. This enables a user to purchase only the exact number needed and it eliminates the unsightliness of a handgun storage rack having empty slots. The preferred embodiments of the handgun display stand of this invention are easily customized by bending the first segment to hold the handgun at the desired position. The stand is inexpensive, lightweight, and does not damage either the handgun or the surface upon which it sits. A variety of embodiments are available to suit different display and storage configurations.

Figure 34:
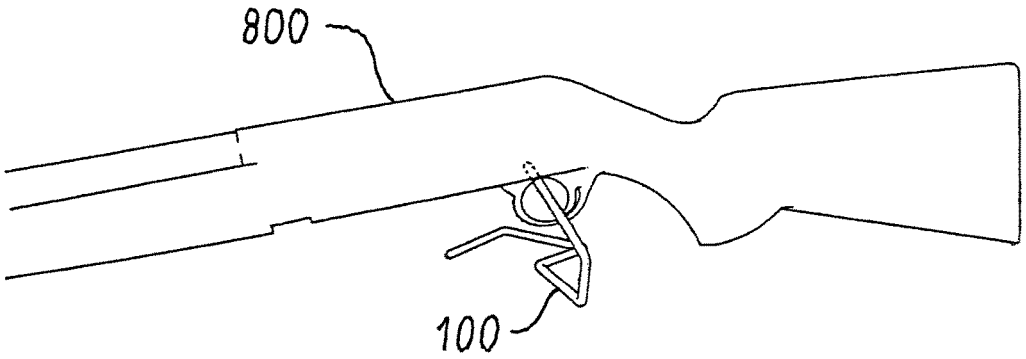
FIG. 34 is a perspective view of the first embodiment being used to display a long gun.
Figure 35:
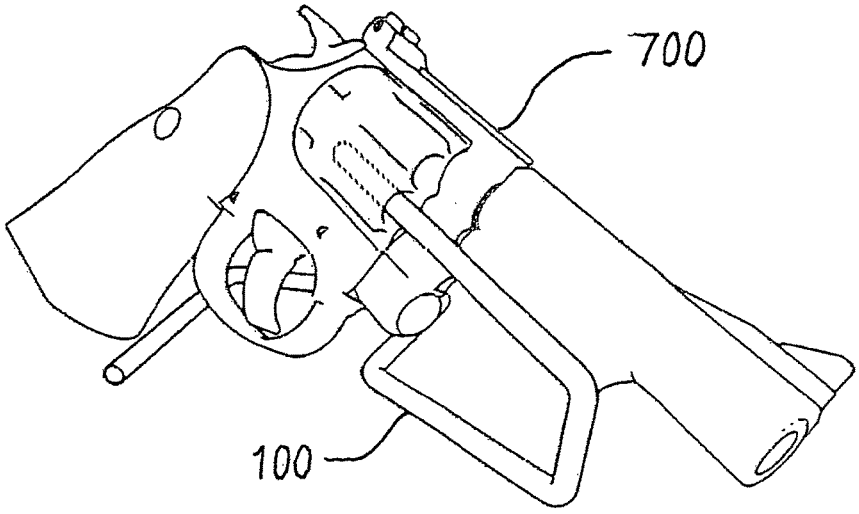
FIG. 35 is a perspective view of the first embodiment being used to display a revolver.

If desired, the handgun display stand can be used in different ways. For example, the stand can display a revolver 700 by inserting the first segment into either the barrel or into one of the cylinder chambers as shown in FIG. 35. The stand can also display a long gun 800 (a rifle or a shotgun) by placing the trigger guard onto the first segment such that the gun is perpendicular to the first segment as shown in FIG. 34.

3. Additional Embodiments

A second embodiment 200 of the stand is shown in FIGS. 5 to 8. The second embodiment is similar to the first except the fifth segment contains three portions 250*a*, 250*b*, and 250*c* that form a hook for securing the base to a shelf. It can be seen that the handgun is displayed with its barrel end facing the end of the shelf. The thickness of the hook is chosen to fit the type of shelf with which it will be used. The embodiment shown is designed to fit on a wooden shelf having a thickness of about one-half inch.

A third embodiment 300 of the stand is shown in FIGS. 9 to 12. The third embodiment is similar to the second embodiments except the hook of the fifth segment is configured in an opposite direction so the handle end of the handgun is displayed facing the end of the shelf. The thickness of the hook is chosen to fit the type of shelf with which it will be used. The embodiment shown is designed to fit on a glass shelf having a thickness of about one-fourth inch.

A fourth embodiment 400 of the stand is shown in FIGS. 13 to 16. The fourth embodiment is similar to the second embodiments except the hook extends to form a holder for a second handgun below the shelf. As discussed above, the thickness of the hook is chosen to fit the type of shelf with which it will be used.

A fifth embodiment 500 of the stand is shown in FIGS. 17 to 20. The fifth embodiment is similar to the first embodiment except that the fifth segment connects back to the distal end of the third segment to form a diamond base. The fifth embodiment is shown with an optional circular disc 560 attached for providing information about the handgun.

A sixth embodiment 600 of the stand is shown in FIGS. 21 to 24. The sixth embodiment can be considered as two first embodiment stands that are joined together by a transverse segment. The fifth embodiment is useful when it is desirable to display two handguns in close proximity to each other.

I claim:

1. A method for displaying a handgun on a horizontal display surface with a desired amount of leaning for optimal display and for optimal space utilization, the method comprising:

(a) providing a handgun having a handle and a barrel, the handle and barrel forming a center plane dividing the handgun into a left half and a right half that are substantially mirror images;

(b) providing a stand comprising: a first segment of plastic coated wire having a length of two to four inches oriented at an angle of about 10 to 70 degrees to the horizontal surface, the angle being adjustable by hand; (ii) a second segment of plastic coated wire connected to the first segment, the second segment having a length of one-half to two inches and being oriented substantially vertically; and (iii) a horizontal base connected to the second segment, the horizontal base resting on the horizontal surface;

(c) providing a horizontal display surface;

(d) inserting the first segment of the stand into the barrel of the handgun and resting the handle of the handgun on the horizontal display surface such that the angle of the center plane of the handgun relative to the horizontal display surface is determined by the angle made by the first segment of the stand to the horizontal display surface; and (e) bending the first segment to create a greater or lesser angle to increase or decrease the angle made by the center plane of the handgun to the horizontal display surface.

2. The method of claim 1 wherein the wire of the stand forming the first segment and second segment is made of steel wire having a diameter of about 0.1 to 0.3 inches.

3. The method of claim 2 wherein the plastic coating of the wire of the stand forming the first segment and second segment comprises polyvinyl chloride, polyethylene, polypropylene, polyamide, polycarbonate, or acrylonitrile butadiene styrene.

4. The method of claim 1 wherein the horizontal display surface comprises a shelf and wherein the horizontal base of the stand additionally comprises a hook that is inserted onto the shelf.

* * * * *